US006990790B2

(12) United States Patent
Yasuhira

(10) Patent No.: US 6,990,790 B2
(45) Date of Patent: Jan. 31, 2006

(54) DEAERATING METHOD AND DEAERATING APPARATUS IN A BAG-FILLING PACKAGING MACHINE

(75) Inventor: Masanori Yasuhira, Iwakuni (JP)

(73) Assignee: Toyo Jidoki Co., Ltd., Tokyo (JP)

( * ) Notice: Subject to any disclaimer, the term of this patent is extended or adjusted under 35 U.S.C. 154(b) by 0 days.

(21) Appl. No.: 10/461,223

(22) Filed: Jun. 13, 2003

(65) Prior Publication Data

US 2003/0230055 A1 Dec. 18, 2003

(30) Foreign Application Priority Data

Jun. 14, 2002 (JP) ..... 2002-174996

(51) Int. Cl.
*B65B 31/04* (2006.01)

(52) U.S. Cl. ..... 53/512; 53/88; 141/65

(58) Field of Classification Search ..... 53/432, 53/434, 510, 512, 88; 141/7, 8, 65, 10, 114, 141/313

See application file for complete search history.

(56) References Cited

U.S. PATENT DOCUMENTS

| | | | | |
|---|---|---|---|---|
| 2,634,562 A | | 4/1953 | Mueller et al. | |
| 4,926,613 A | | 5/1990 | Hansen | |
| 5,097,648 A | * | 3/1992 | Berner et al. | 53/88 |
| 5,144,788 A | * | 9/1992 | Varlet | 53/434 |
| 5,551,213 A | * | 9/1996 | Koelsch et al. | 53/434 |
| 5,711,136 A | * | 1/1998 | Carcano | 53/434 |

FOREIGN PATENT DOCUMENTS

| | | |
|---|---|---|
| DE | 18 00 525 | 5/1970 |
| DE | 197 05 743 | 8/1998 |
| FR | 2 067 500 | 8/1971 |
| JP | 4-44927 | 2/1992 |
| JP | 7-2233 | 1/1995 |
| JP | 10-181713 | 7/1998 |

* cited by examiner

*Primary Examiner*—Louis K. Huynh
*Assistant Examiner*—Thanh Truong
(74) *Attorney, Agent, or Firm*—Koda & Androlia

(57) ABSTRACT

A deaerating method and deaerating apparatus in a bag-filling packaging machine, using a pair of press-holding members with one of them having a main body and a slide element that fits in the main body. A vacuum passage is formed between the upper portion of the slide element and the main body, and a groove is formed on a press-holding surface side when the slide element is moved backward; and with this groove, a passage leading from the inside to the outside of a bag is formed. Air and excess liquid matter inside the bag are sucked out of the bag through the passage and are removed through the vacuum passage. When the slide element is moved forward and press-holds the portion of the mouth that corresponds to the passage, the liquid matter inside such portion is pushed and is removed through the vacuum passage.

6 Claims, 8 Drawing Sheets

DEAERATING METHOD AND DEAERATING APPARATUS IN A BAG-FILLING PACKAGING MACHINE

BACKGROUND OF THE INVENTION

1. Field of the Invention

The present invention relates to a deaerating method and deaerating apparatus for removing air from the inside of a bag that is filled with contents which is a liquid matter or with contents that contain a liquid matter.

2. Prior Art

Japanese Patent Nos. 3016052 (corresponding to Japanese Patent Application Laid-Open No. 7-2233) and 3138916 (corresponding to Japanese Patent Application Laid-Open No. 10-181713) disclose a deaerating method and apparatus for removing air from the insides of bags that are filled with a liquid matter or with contents that contain a liquid matter.

In the methods and apparatuses of these prior art patents, a suction nozzle that communicates with a vacuum source is inserted into a bag though its mouth, and air and excess liquid matter inside the bag are sucked out by the suction nozzle. In other words, in these prior art, the suction nozzle is inserted into the interior of the bag. Accordingly, there is a danger that contents adhering to the inside of the suction nozzle and coating material peeling from the surface of the suction nozzle (ordinarily, the surface of the suction nozzle is coated with Teflon (trademark) for the purpose of preventing the adhesion of contents) would be admixed with the contents inside the bag. This is an extremely important problem from the standpoint of hygiene in cases where the contents are foodstuffs.

Japanese Patent No. 2805378 (corresponding to Japanese Patent Application Laid-Open No. 4-44927) discloses an apparatus that fills packages under deaerated conditions.

In this apparatus, an area below the intended sealing position of the mouth of a bag is held by a chamber that has a pair of jaw-shaped members formed with air passage grooves. A vacuum is applied to the interior of the chamber so that the air inside the bag is sucked out through the air passage grooves, and then a sealing bar disposed inside the chamber is then actuated so as to seal the intended sealing position. However, if excess liquid matter inside the bag is sucked out together with the air from the locations of the air passage grooves, this liquid matter escapes through the locations of the air passage grooves inside the chamber and spreads throughout the entire intended sealing position, and it further overflows from the mouth of the bag and enters the interior of the chamber. The cleaning away of liquid matter that has overflowed into the interior of the chamber is cumbersome and time-consuming due to the complexity of the structure involved.

In any of the above-described systems, the adhesion and retention of liquid matter in the intended sealing position of the mouth of a bag is unavoidable, and this liquid matter enters the seal, leading to defective sealing. More specifically, in the case of the system that uses a suction nozzle described above, the liquid matter sucked out by the suction nozzle would remain in the location in the mouth of the bag where the suction nozzle was present, so that this liquid matter enters the seal when sealing is performed. In the case of the system that uses a chamber comprising jaw-shaped members described above, liquid matter adhering to the entire sealing position and liquid matter in the locations of the air passage grooves remains in the seal of the mouth during sealing.

SUMMARY OF THE INVENTION

In view of the above, the object of the present invention is to provide a method and apparatus that prevents admixture of adhering matter and foreign matter, etc. with the contents inside a bag by way of not using a suction nozzle in a case where air removal (deaeration) is performed inside the bag that are filled with contents of a liquid matter or contents that contain a liquid matter.

Another object of the present invention is to provide a method and apparatus that prevents the liquid matter sucked out together with air from spreading throughout the entire mouth portion of a bag and ensures no great cleaning effort.

Still another object of the present invention is to provide a method and apparatus that prevents the entry of a liquid matter into the seal.

The above objects are accomplished by a unique deaerating method of the present invention that includes the steps of:

- press-holding a mouth of a bag by a pair of press-holding members up to the upper-end edge of the bag while leaving a portion that constitutes a passage which leads from an inside of the bag to an outside of the bag;
- causing a vacuum to act on a vacuum passage that opens at press-holding surfaces of the press-holding members and that communicates with an upper end of the passage that leads from the inside of the bag to the outside of the bag;
- sucking air and excess liquid matter inside the bag out through the passage; and
- removing the air and excess liquid matter through the vacuum passage.

In this deaerating method, it is preferable to use a known mechanical deaerating means such as press deaerating (also described in the above listed prior art Japanese patents) in order to remove air from the inside of the bag and discharge excess liquid matter.

In the above deaerating method, the mouth of a bag is in a closed state when the mouth is press-held by the press-holding members; however, the portion that constitutes the passage is not press-held. Accordingly, deaerating and the discharge of excess liquid matter can be accomplished through this portion. Furthermore, since the mouth of the bag is closed off by being press-held up to its upper-end edge except for the portion that corresponds to the passage, a liquid matter that leaves the bag through the passage does not spread in the direction of width of the mouth and does not broadly wet the intended sealing location; instead, the liquid matter is discharged "as is" through vacuum passage that opens in the press-holding surfaces.

In the deaerating method of the present invention, it is preferable that a portion of the passage in the mouth of the bag be further press-held up to the upper-end edge of the mouth, thus pushing the liquid matter present in the passage out of the passage and removing the liquid matter that has been pushed out to the outside of the bag through the vacuum passage. Accordingly, the liquid matter that remains in the passage is pushed out and discharged, and the entry of liquid matter into the seal is securely prevented.

Furthermore, in the deaerating method of the present invention, it is preferable to form the passage so as to gradually become wider in downward direction. With this structure, suction is broadly applied in the direction of the width of the inside of the bag, and deaerating is performed in a secure and stable fashion.

The above objects are further accomplished by a unique structure of the present invention for a deaerating apparatus, and such a unique structure includes:

a pair of press-holding members that press-hold the mouth of a bag from both sides of the bag by means of flat press-holding surfaces of the press-holding members, the flat press-holding surfaces having a predetermined length in a vertical direction;

a vacuum passage provided in at least one of the press-holding members, one end of the vacuum passage communicating with a vacuum source and another end of the vacuum passage opening in a press-holding surface of such one of the press-holding members at a position lower than the upper-end edge of the press-holding surface; and a groove disposed along the press-holding surface so as to reach the vacuum passage from the lower-end edge of the press-holding surface.

In this apparatus of the present invention, the mouth of a bag is press-held up to its upper-end edge by the press-holding surfaces of the pair of press-holding members. However, since the mouth is not press-held at its portion where the groove is present, a passage that leads from the inside of the bag to the outside of the bag is formed in the portion that corresponds to this groove. Accordingly, deaeration and discharge of excess liquid matter are accomplished by this passage. The deaerating method described above is performed by this deaerating apparatus.

Furthermore, the above described objects are accomplished by a still another unique structure of the present invention for a deaerating apparatus that includes a pair of press-holding members that press-hold a mouth of a bag from both sides of the bag by means of flat press-holding surfaces of the press-holding members, the flat press-holding surfaces having a predetermined length in a vertical direction; and in this structure, at least one of the press-holding members is comprised of a main body and a slide element that is fitted inside the main body and is caused to advance and retract perpendicularly with respect to the press-holding surface of such one of the press-holding members;

a space that acts as a vacuum passage that communicates at one end thereof with a vacuum source is formed between the upper portion of the slide element and the main body; and the front surface of the slide element forms a part of the press-holding surface of such one of the press-holding members when the slide element is caused to advance, and a groove that has a predetermined depth and reaches from the lower-end edge of the press-holding surface to the vacuum passage is formed along the press-holding surface when the slide element is caused to retract.

In this apparatus, the groove is formed along the press-holding surface of one of the press-holding members when the slide element is caused to retract perpendicularly to the press-holding surface of the press-holding member. The deaerating method described above is performed also by this deaerating apparatus.

In the deaerating apparatuses of the present invention described above, it is preferable that the groove be formed in an inverted V shape and thus become wider in the downward direction.

DETAILED DESCRIPTION OF THE INVENTION

The deaerating method and deaerating apparatus of the present invention will be described in detail below with reference to FIGS. 1 through 8.

Figure 1:
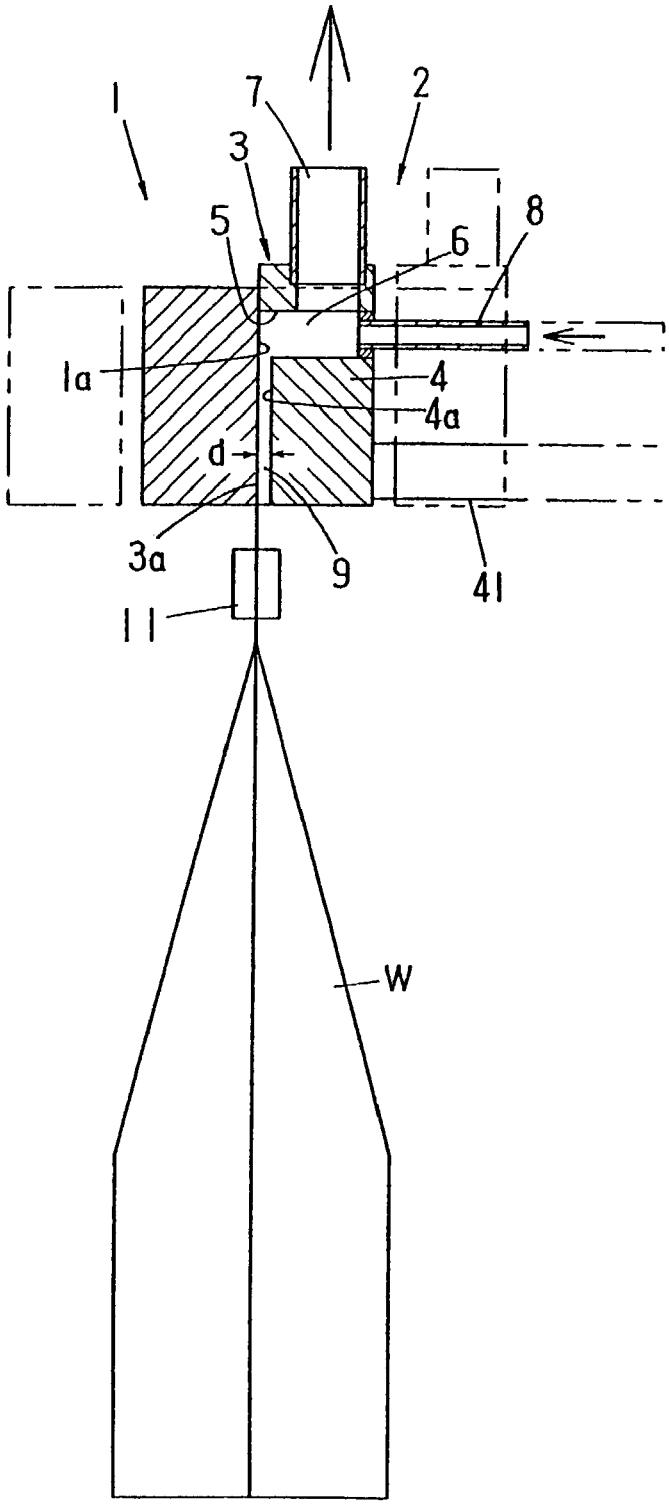
FIG. 1 is a sectional side view of the press-holding members of the present invention.
Figure 2:
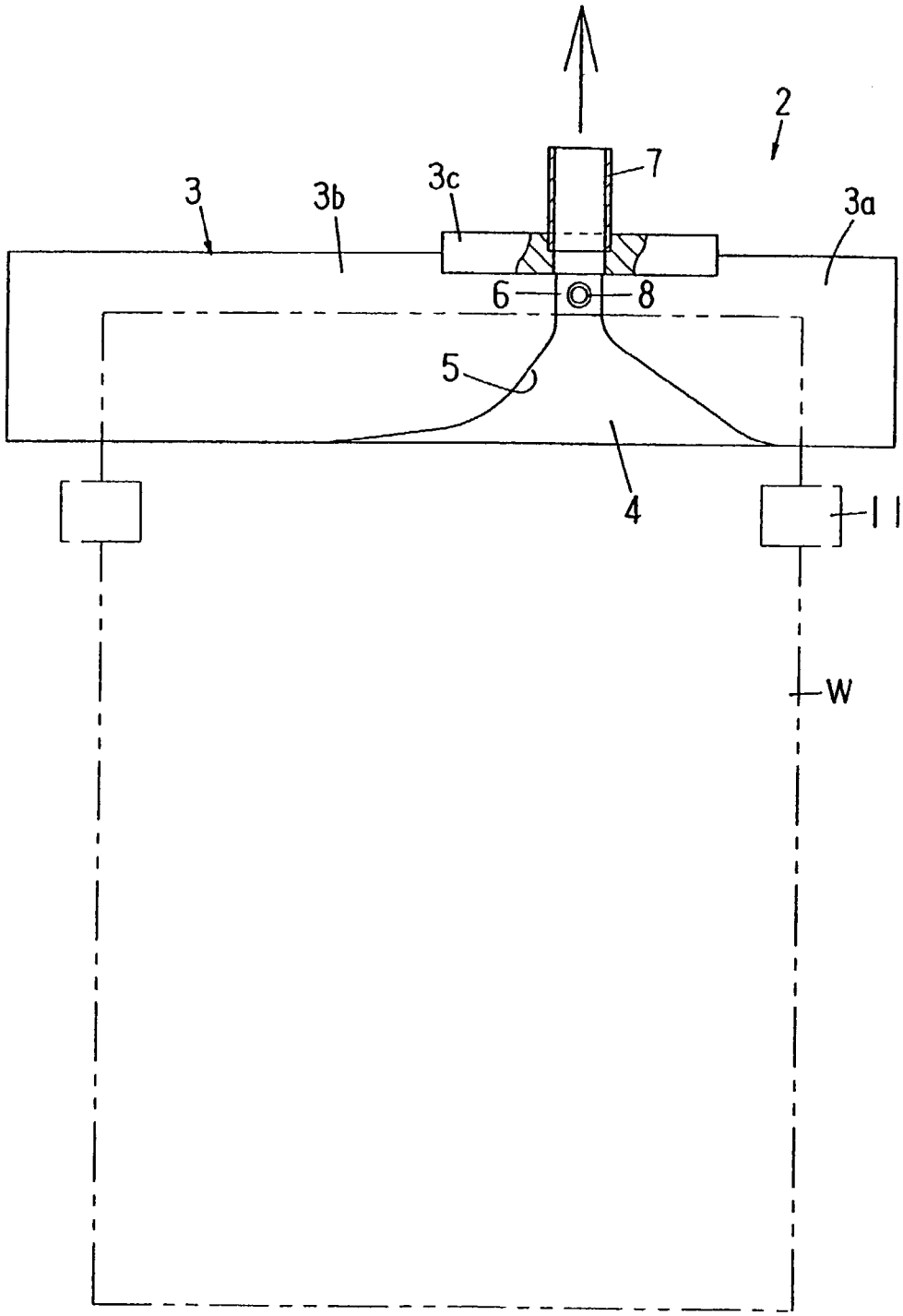
FIG. 2 is a partially sectional front view of one of the press-holding members.

FIGS. 1 and 2 show press-holding members 1 and 2 of the deaerating apparatus.

The press-holding member 1 has a press-holding surface 1*a* which is completely perpendicular and flat, and it is moved between the solid line position and imaginary line position shown in FIG. 1.

The press-holding member 2 is comprised of a main body 3 and a slide element 4. The press-holding member 2 is moved between the solid line position and the imaginary line position shown in FIG. 1.

The main body 3 is provided with a cut-out 5 that is formed at an intermediate position with respect to the direction of width (see FIG. 2) of the main body 3. The cut-out 5 is in substantially an inverted V shape that extends from the position slightly below the upper end of the main body 3 to the lower-end edge thereof and becomes wider in the downward direction as shown in FIG. 2. The main body 3 has a flat vertical press-holding surface 3*a* except for the location where the cut-out 5 is formed.

The slide element 4 is fitted in the cut-out 5 with a space (that makes a vacuum passage 6) left in the upper portion. The slide element 4 is movable (or it is caused to advance and retract) in the direction perpendicular to the press-holding surface 3*a*.

The vacuum passage 6 is horizontally oriented; and a piping member 7, which communicates with a vacuum source (not shown) via filters, switching valves, etc. (not shown), is connected to the upper portion of the vacuum passage 6. Furthermore, a piping member 8, which communicates with a cleaning water supply source (not shown) via filters, switching valves, etc. (not shown), is connected to the rear portion of the vacuum passage 6.

The main body 3 is comprised of a block section 3*b* and an attachment section 3*c* (which is for attaching the piping members 7 and 8) that are formed into an integral unit; and the front surfaces of these sections are set to be flush (on the same plane), thus forming the above-described press-holding surface 3*a*.

The slide element 4 is caused to advance and retract in relative terms with respect to the main body 3. The front surface 4*a* of the slide element 4 is completely vertical and flat. When the slide element 4 advances, the front surface 4*a* arrives at a position that is flush with the press-holding surface 3*a* of the main body 3 and forms a part of the press-holding surface that faces the mouth of a bag together with the press-holding surface 3*a*. When the slide element 4 retracts, it is in the position shown in FIG. 1; and a groove 9 having a depth d and an inverted V shape (as seen from FIG. 2) that reaches the vacuum passage 6 from the lower-end edge of the slide element 4 is formed on the press-holding surface 3*a* side.

The deaerating method that uses these press-holding members 1 and 2 will be described below with reference to FIGS. 3(*a*) through 3(*d*).

Figures 3A, 3B, 3C, 3D:
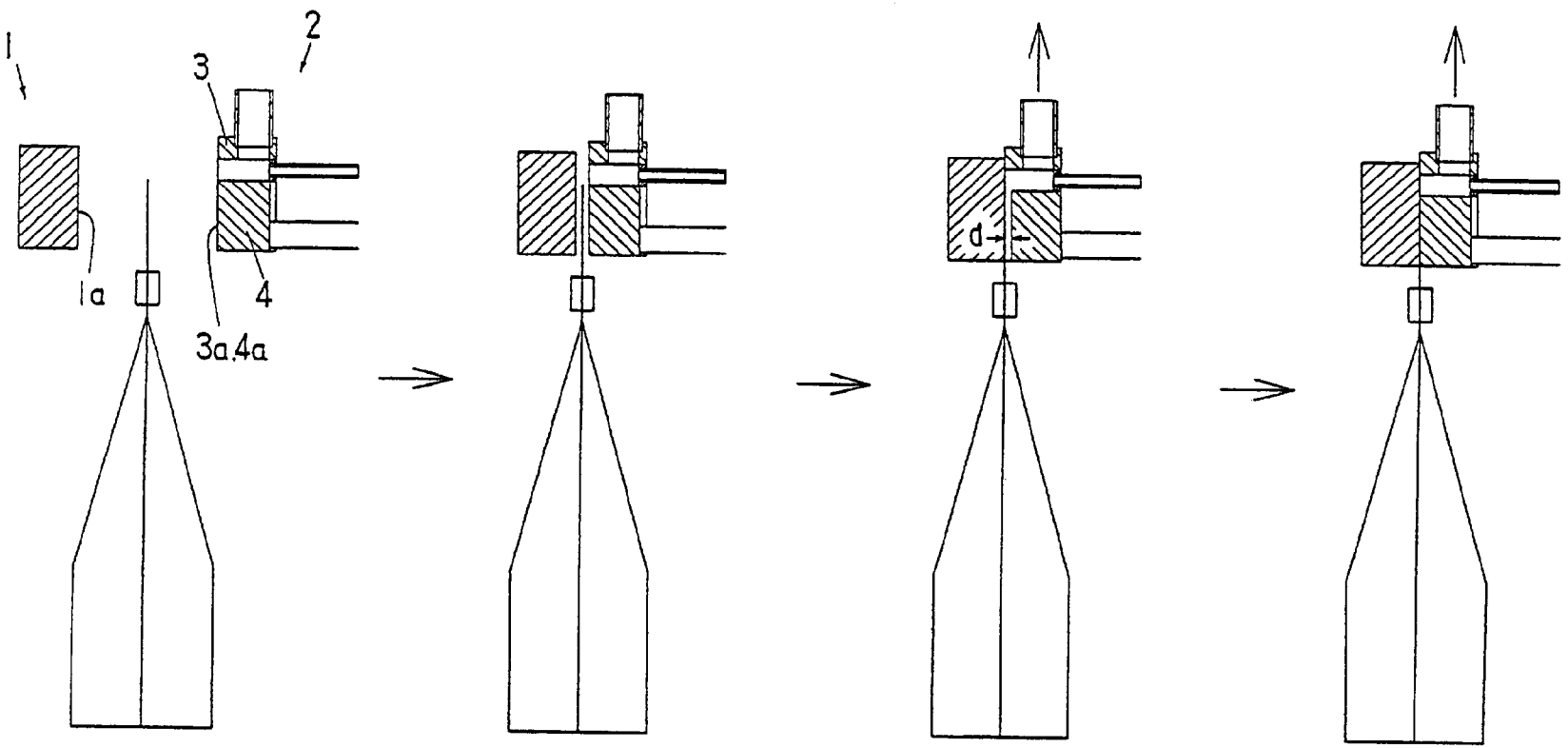
FIGS. 3(*a*) through 3(*d*) show, partially in cross-section, the deaerating method of the present invention in the order of the processes involved.

(a) When a bag W which is held at both side edges thereof by grippers 11 is stopped between the press-holding members 1 and 2 as shown in FIG. 3(*a*), the closing operation of the press-holding members 1 and 2 is initiated. At this moment, the slide element 4 is in the advanced position, i.e., a position in which the front surface 4*a* of the slide element 4 is flush with the press-holding surface 3*a* of the main body 3.

(b) The main body 3 and the slide element 4 of the press-holding member 2 are moved together up to a point immediately prior to the complete closing of the press-holding members 1 and 2 as these elements approach each other as shown in FIG. 3(*b*). However, when the press-holding member 2 reaches this position, the movement of the slide element 4 stops. As clearly shown in FIG. 3(*b*), it is preferable that the bag W be positioned or set in terms of its height so that the upper-end edge of the mouth is at the same height as or slightly lower than the upper-end edge of the slide element 4 (or conversely, so that the upper-end edge of the slide element 4 is at the same height as or slightly higher than the upper-end edge of the mouth of the bag).

(c) The press-holding member 1 and the main body 3 of the press-holding member 2 come into contact with each other as shown in FIG. 3(*c*) (i.e., the slide member is at the retracted position by a distance d relative to the main body 3), and the press-holding surfaces 1*a* and 3*a* press-hold the mouth of the bag up to the upper-end edge of the mouth. At the same time or at timing around this time, vacuum suction is initiated. At this moment, the slide element 4 is in the retracted position; and thus the groove 9 that has the depth d and reaches the vacuum passage 6 from the lower end-edge of the press-holding surface 3*a* is formed on the press-holding surface 3*a* side. As a result, a passage that leads from the inside of the bag to the outside of the bag is formed in the mouth of the bag W in the portion that corresponds to the groove 9 which is not press-held, and air and excess liquid matter inside the bag are sucked out and discharged from the bag through this passage by the force of the vacuum suction (with the action of pressing deaerating, etc. added if necessary). This air and liquid matter pass through the vacuum passage 6 and discharged to the outside through the piping member 7.

(d) Next, the slide element 4 is moved to the advanced position as shown in FIG. 3(*d*), and the press-holding surface 1*a* of the press-holding member 1 and the front surface 4*a* of the slide element 4 press-hold the area of the mouth that was previously located in the portion corresponding to the groove 9, including the upper-end edge of the mouth of the bag. As a result, the liquid matter that previously accumulated in the passage of the mouth is pushed out, and the liquid matter that is thus been pushed out of the bag passes through the vacuum passage 6 and is discharged to the outside through the piping member 7.

Then, the press-holding members 1 and 2 are separated, the vacuum suction is stopped, and the bag W is moved toward the position of the subsequent sealing process.

The mixture of air and liquid matter that is discharged to the outside of the bag can be separated into air and liquid matter by a filter as described, for example, in the Japanese Patent No. 3016052, and the liquid matter is either discarded or if necessary re-utilized.

The press-holding members 1 and 2 are cleaned upon necessity. The press-holding surfaces 1*a* and 3*a* of the press-holding members 1 and 2 and the front surface 4*a* of the slide element 4 that are exposed to the outside can easily be cleaned. The vacuum passage 6, the piping member 7, etc. that are not exposed to the outside can be subjected to fixed-position cleaning (cleaning without disassembly) by supplying cleaning water through the piping members from the cleaning water supply source in the state shown in FIG. 3(*d*).

Next, the driving mechanism of the press-holding members 1 and 2 (and of the slide element 4) will be described with reference to FIG. 4 through 8. The description will be made for a deaerating apparatus that is used in a two-unit bag-filling packaging machine (i.e., a system in which two bags are treated simultaneously), and two mechanisms that are essentially the same are installed side by side.

Figure 4:
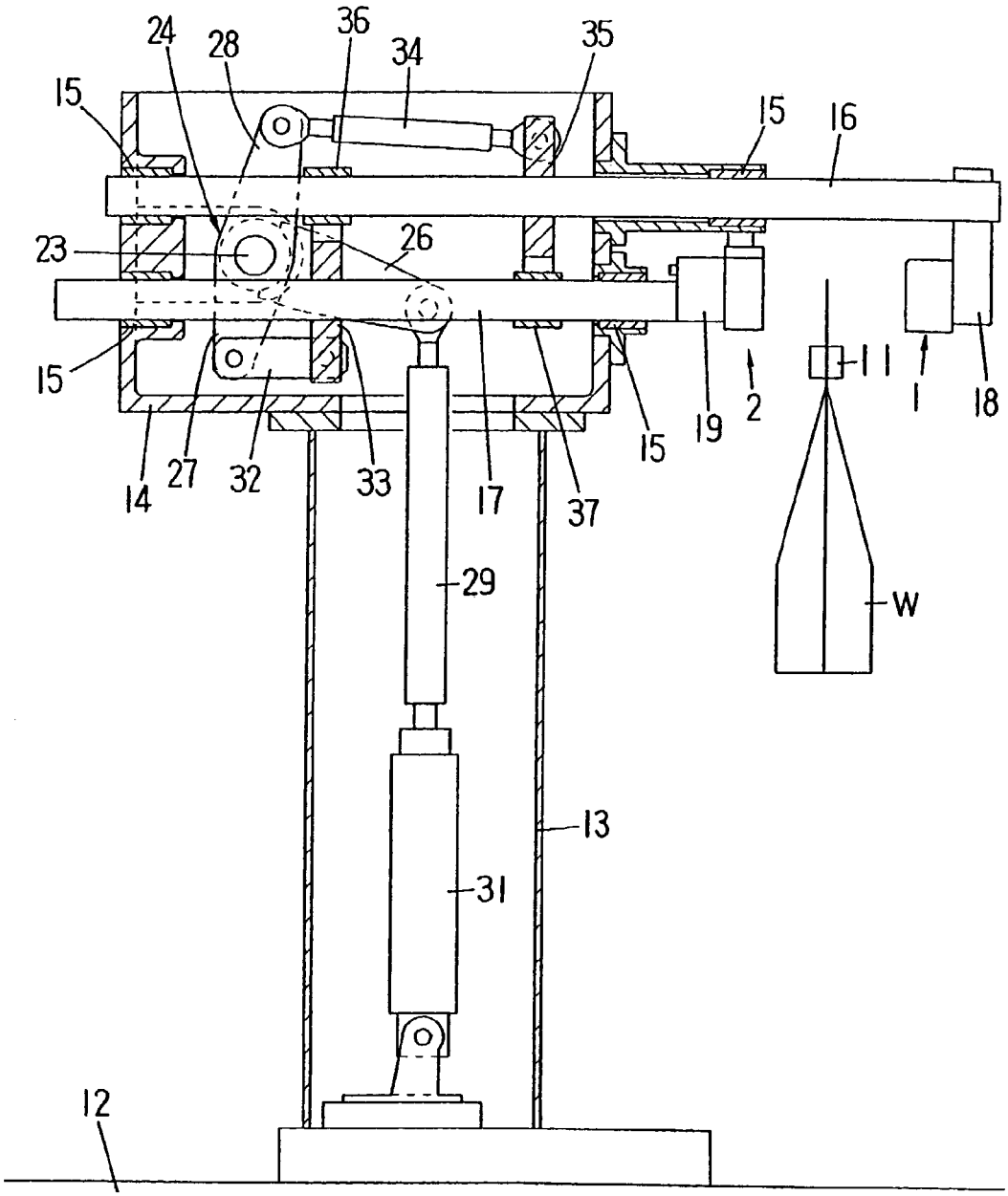
FIG. 4 is a sectional side view of the deaerating apparatus of the present invention.
Figure 5:
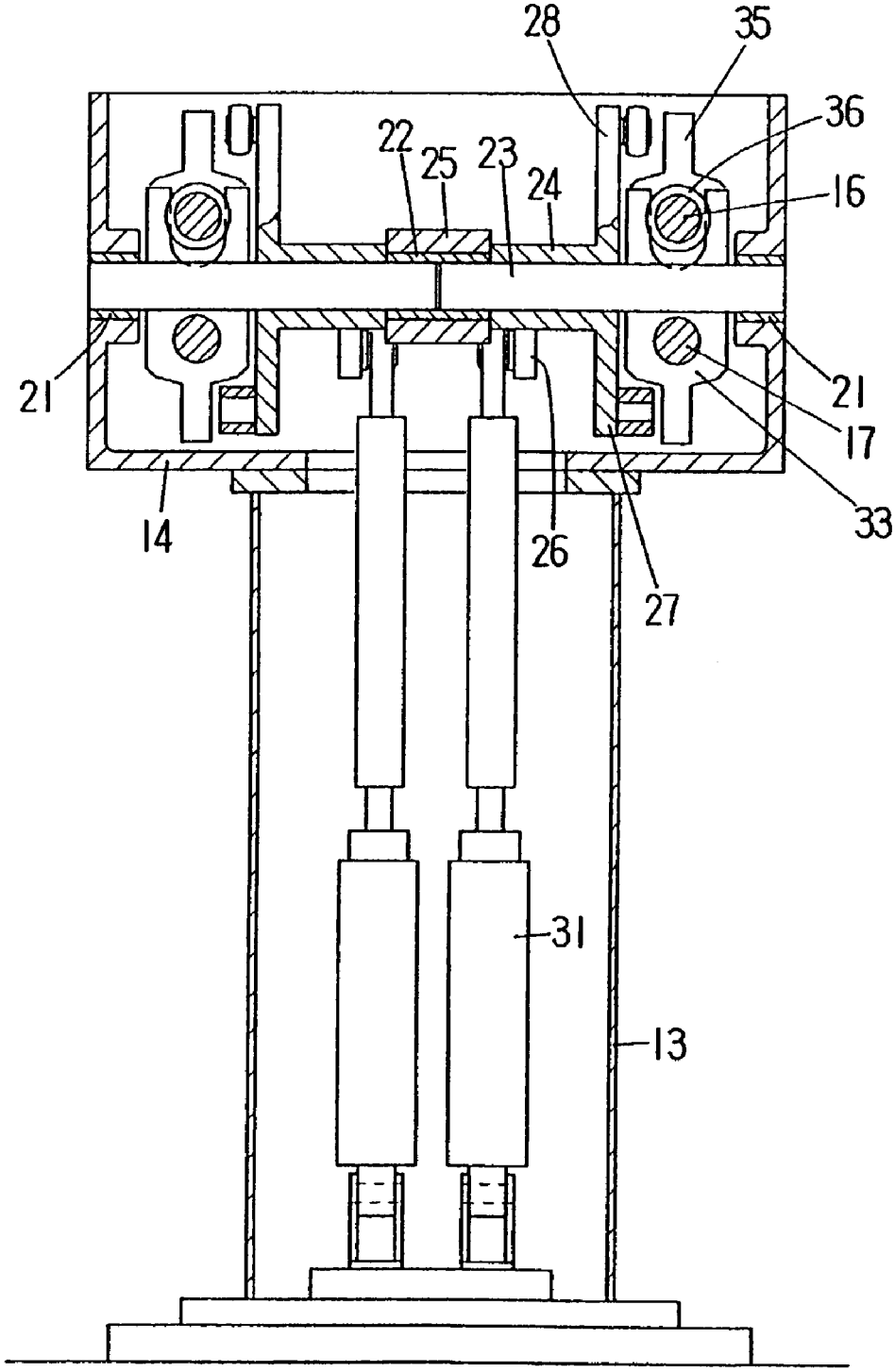
FIG. 5 is a sectional rear view thereof.

As shown mainly in FIGS. 4 and 5, a stand 13 is installed uprightly on the base 12, and a supporting box 14 is fastened to the upper end of this stand 13. An upper-side sliding shaft 16 and a lower-side sliding shaft 17 are horizontally supported via a bush 15 in this supporting box 14. The press-holding member 1 is fastened to the tip end of the upper-side sliding shaft 16 via an attachment block 18, and the main body 3 of the press-holding member 2 is fastened to the tip end of the lower-side sliding shaft 17 via an attachment block 19.

A supporting shaft 23, which is rotatable, is supported perpendicular to the upper-side sliding shaft 16 and lower-side sliding shaft 17 via bushes 21 and a bush 22 inside the supporting box 14, and a swing lever 24 is fastened to the circumference of this supporting shaft 23. The bush 22 is held inside a supporting shaft supporting block 25 that is fastened inside the supporting box 14. The swing lever 24 has a first arm 26, second arm 27 and third arm 28. The tip end of the first arm 26 is connected to an air cylinder 31 via a connecting rod 29, the tip end of the second arm 27 is connected to a rear-side advancing and retracting block 33 via a connecting member 32, and the tip end of the third arm 28 is connected to a front-side advancing and retracting block 35 via a connecting rod 34.

The rear-side advancing and retracting block 33 is fastened to the lower-side sliding shaft 17 and supports the upper-side sliding shaft 16 via a rotation-stopping bush 36 (so that rotation of the upper-side sliding shaft 16 is prevented), while the front-side advancing and retracting block 35 is fastened to the upper-side sliding shaft 16 and supports the lower-side sliding shaft 17 via a rotation-stopping bush 37 (so that rotation of the lower-side sliding shaft 17 is prevented).

When the air cylinder 31 is actuated, and the piston rod of this cylinder is extended, the swing lever 24 rotates leftward in FIG. 4, so that the upper-side sliding shaft 16 is moved to the left (retracts) and the lower-side sliding shaft 17 is moved to the right (advances), thus causing the press-holding members 1 and 2 to close or come into contact with each other. Conversely, when the piston rod is retracted (in the state shown in FIG. 4), the press-holding members 1 and 2 open or are separated.

Figure 6:
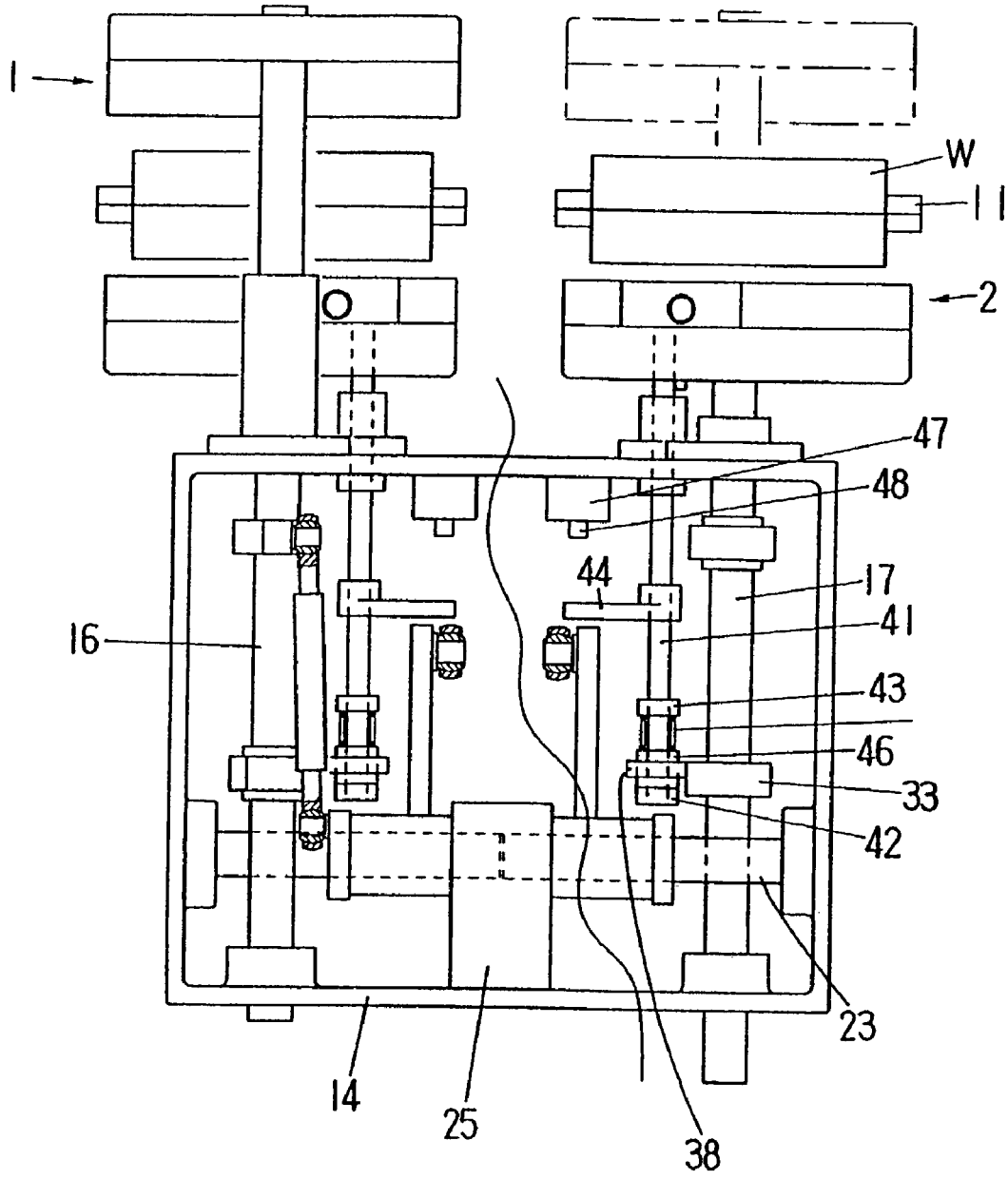
FIG. 6 is a top view thereof, partially in cross section.
Figure 7:
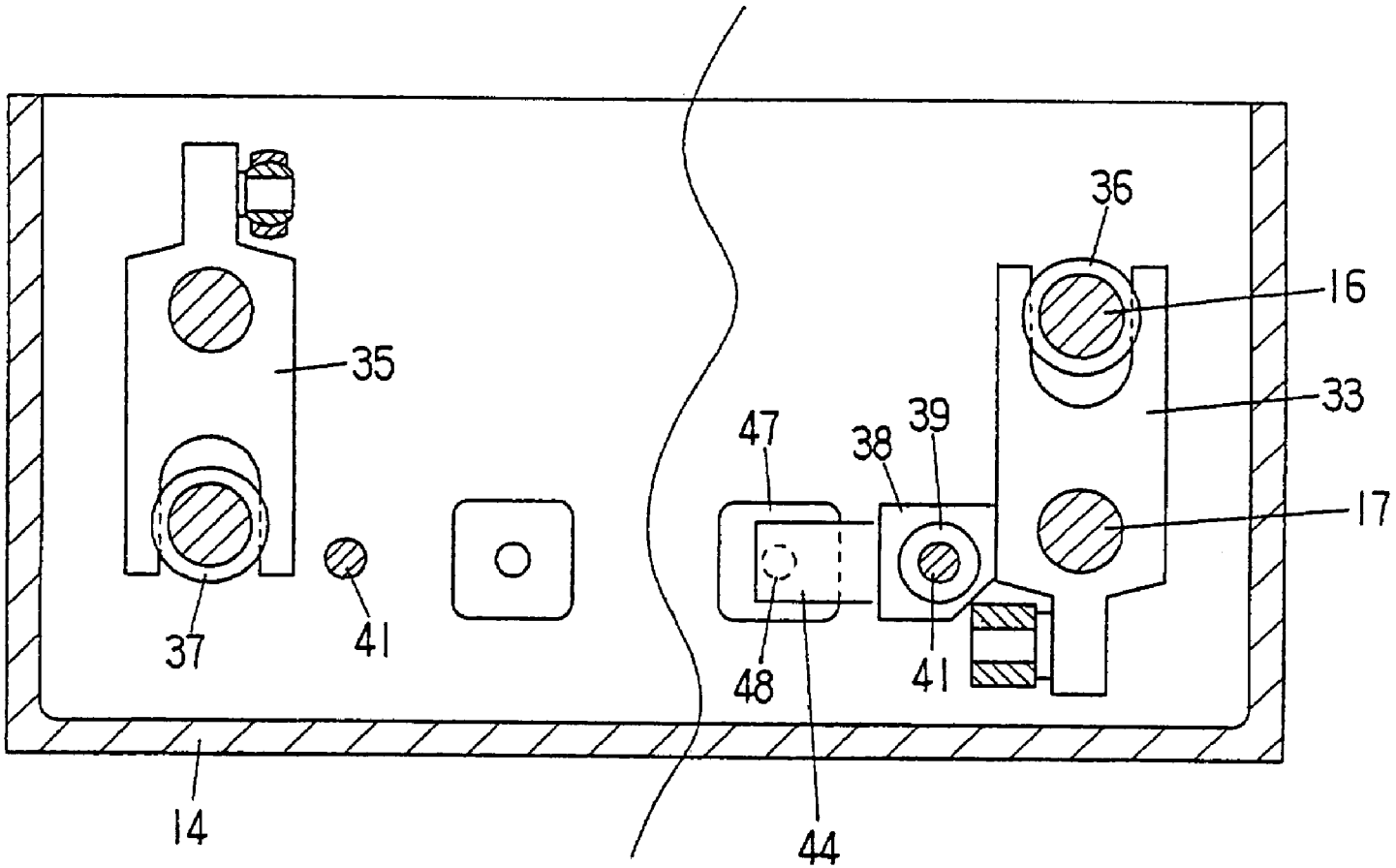
FIG. 7 is a sectional front view showing the action of the sliding shafts.
Figure 8:
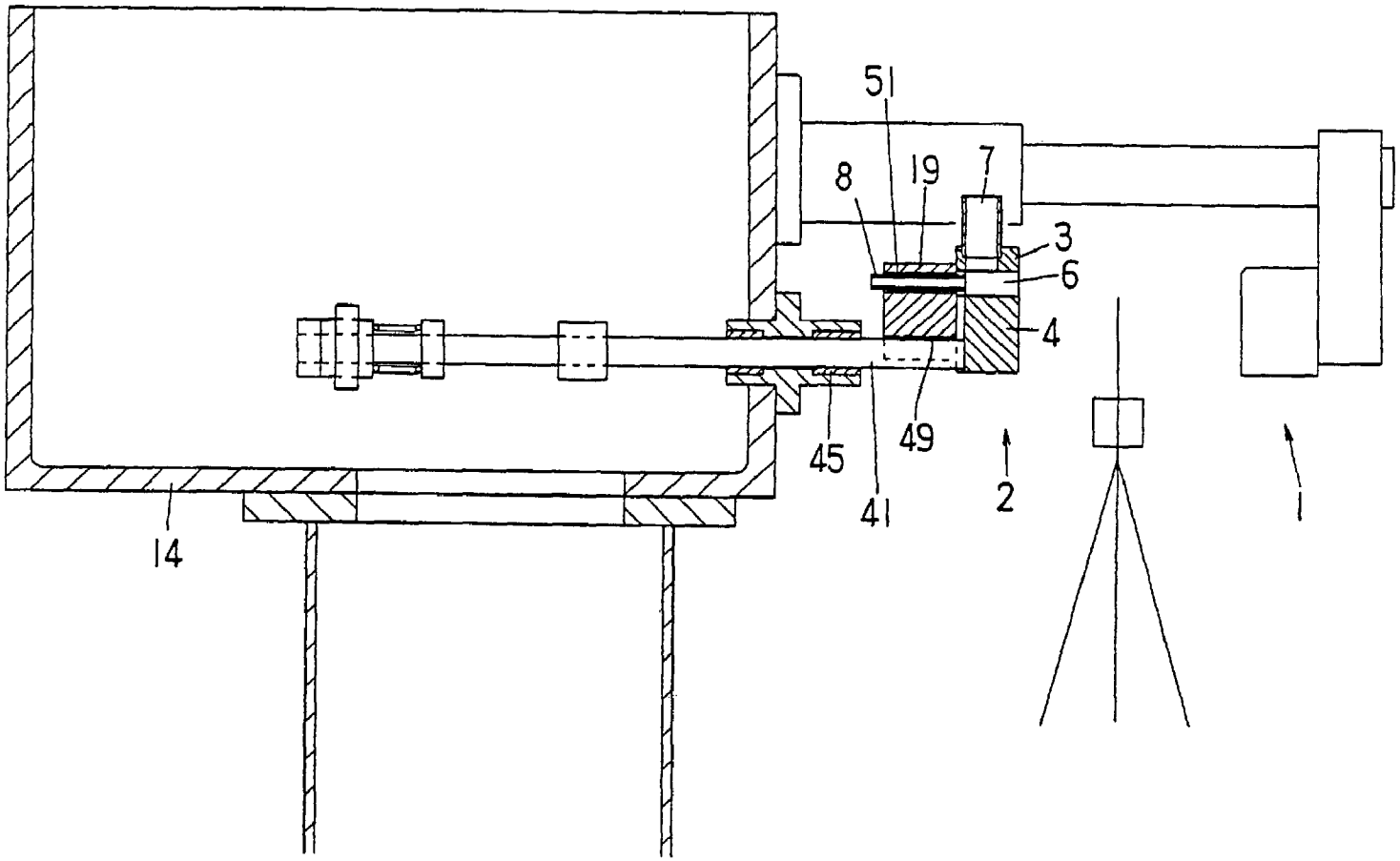
FIG. 8 is a sectional side view showing the action of the sliding shafts.

As shown in FIGS. 6 through 8, a sliding shaft supporting part 38 is formed on the side surface of each rear-side advancing and retracting block 33, and a sliding shaft 41 is slidably supported in this supporting part 38 via a holder 39. A stopper 42 is fastened to the end portion of the sliding shaft 41, a spring receiving member 43 is fastened to the sliding shaft 41 in front of this stopper 42, and a contact bar 44 is fastened to the sliding shaft 41 in front of this spring receiving member 43. Furthermore, the sliding shaft 41 in front of this contact bar 44 is supported on the supporting box 14 via a bush 45 so that the sliding shaft 41 can slide. A compression spring 46 is interposed between the holder 39 and the spring receiving member 43, so that the sliding shaft 41 is constantly driven forward. An air cylinder 47 is disposed inside the supporting box 14, and the piston rod 48 of this air cylinder 47 faces the contact bar 44.

As seen from FIG. 8, an escape recess (cut-out) 49 for the sliding shaft 41 and an escape hole 51 for the piping member 8 are formed in the attachment block 19.

The tip end of the sliding shaft 41 is fastened to the rear portion of the slide element 4 of the press-holding member 2. When the sliding shaft 41 is driven forward by the compression spring 46 so that the stopper 42 contacts the holder 39, the slide element 4 of the press-holding member 2 is in the advanced position relative to the main body 3, and the front surface 4*a* of the slide element 4 is in a position that is flush with the press-holding surface 3*a* of the main body 3(see FIG. 8 or FIG. 3(*a*)).

When the air cylinder 31 is actuated, and the upper-side sliding shaft 16 retracts and the lower-side sliding shaft 17 advances, thus causing the press-holding members 1 and 2 to close or come into contact with each other, each sliding shaft 41 advances together with the lower-side sliding shaft 17. In this case, each air cylinder 47 is actuated and the corresponding piston rod 48 is protruded, and the corresponding contact member 44 contacts the piston rod 48 immediately prior to the complete closure of the press-holding members 1 and 2, so that the advance of the sliding shaft 41 is stopped against the driving force of the compression spring 46 (see FIG. 3(*b*)). Meanwhile, the retraction of the upper-side sliding shaft 16 and the advance of the lower-side sliding shaft 17 continue, so that the press-holding member 1 and the main body 3 of the press-holding member 2 are closed or come into contact (see FIG. 3(*c*)). Next, when the air cylinder 47 is actuated in reverse so that the piston rod 48 is retracted, each sliding shaft 41 is caused to advance by the driving force of the corresponding compression spring 46. Consequently, the slide element 4 of the press-holding member 2 advances by a distance d, and the front surface 4*a* of the slide element 4 reaches a position that is flush with the press-holding surface 3*a* of the main body 3(see FIG. 3(*d*)).

In the above structure, the slide element 4 of the press-holding member 2 is provided so as to be movable in the main body 3 toward and away from the press-holding member 1. However, the main body 3 and the slide element 4 of the press-holding member 2 can be formed integral at positions shown in FIG. 1 (in other words, a press-holding member 2 can be formed with a groove 9 formed in the press-holding surface of the press-holding member 2 and with the upper end of this groove communicated with the vacuum passage 6 that opens in the press-holding surface of the press-holding member). In this structure, naturally, an operation in which the liquid matter inside the passage of the mouth of a bag is pushed out by causing the slide element to advance is not executed.

As seen from the above, according to the present invention, during the process of deaerating the interior of a bag filled with contents of liquid matter or contents that contain liquid matter, the admixture of adhering matter, foreign matter, etc. with the contents inside the bag is prevented. At the same time, it is possible to ensure that the liquid matter which is sucked out together with the air will not spread throughout the entire mouth of the bag, and no great cleaning effort will be required.

Furthermore, the liquid matter can be driven out of the intended sealing position of the mouth of a bag by way of pressing the passage that leads from the inside of the bag to the outside of the bag at the end of the deaerating process, so that the liquid matter remaining in this passage is pushed out and this liquid matter is removed by suction. Accordingly, the entry of liquid matter into the seal can be more assuredly prevented.

What is claimed is:

1. A deaerating apparatus in a bag-filling packaging machine for deaerating a bag before being sealed in a subsequent sealing process, said deaerating apparatus including a pair of press-holding members that press-hold a mouth of a bag from both sides of and up to the upper-end edge of said mouth by flat press-holding surfaces of said press-holding members, said flat press-holding surfaces having a predetermined length in a vertical direction; wherein at least one of said press-holding members is comprised of a main body and a slide element that is fitted inside a cut-out formed at an intermediate position of said main body with respect to a direction of width of said main body and is caused to advance and retract perpendicularly with respect to said press-holding surface in said cut-out;

a space which acts as a vacuum passage that communicates at one end thereof with a vacuum source is formed between an upper portion of said slide element and said main body; and a front surface of said slide element forms a part of said press-holding surface of said one of said press-holding members when said slide element advances, thus press-holding the mouth up to the upper-end edge thereof and a groove that has a predetermined depth and reaches from a lower-end edge of said press-holding surface to said vacuum passage is formed along said press-holding surface when said slide element retracts:

whereby the mouth of the bag is press-held by said pair of press-holding members with the slide element withdrawn so that air and excess liquid matter inside the bag is sucked out through a vacuum passage communicated with a vacuum source, the air and excess liquid matter is discharged through said vacuum passage, and said slide element is advanced to press-hold the mouth of the bag between the slide element and the press-holding member that faces the slide member thus pushing out the excess liquid matter from the mouth of the bag, and such liquid matter is discharged through said vacuum passage.

2. The deaerating apparatus in a bag-filling packaging machine according to claim 1 wherein said groove is formed so as to gradually become wider in downward direction.

3. The deaerating apparatus in a bag-filling packaging machine according to claim 2 wherein an opening that communicates with a cleaning water supply source is formed in said vacuum passage.

4. The deaerating apparatus in a bag-filling packaging machine according to claim 1 wherein an opening that communicates with a cleaning water supply source is formed in said vacuum passage.

5. The deaerating apparatus in a bag-filling packaging machine according to claim 1 wherein there is only one pair of press-holding members provided.

6. The deaerating apparatus in a bag-filling packaging machine according to claim 5 wherein said space which acts as a vacuum passage extends horizontally.

* * * * *